United States Patent [19]

Schwartz et al.

[11] 4,057,288

[45] Nov. 8, 1977

[54] STACKABLE WHEELED CHAIR

[75] Inventors: Robert T. Schwartz, Takoma Park, Md.; Marc S. Harrison, Foster, R.I.

[73] Assignee: American National Red Cross, Washington, D.C.

[21] Appl. No.: 739,860

[22] Filed: Nov. 9, 1976

[51] Int. Cl.[2] ..... A47C 3/04

[52] U.S. Cl. ..... 297/239; 297/DIG. 4

[58] Field of Search ..... 297/239, DIG. 4; 280/33.99 T

[56] References Cited

U.S. PATENT DOCUMENTS

| | | | |
|---|---|---|---|
| 1,911,224 | 5/1933 | Dellert | 297/239 |
| 1,966,343 | 7/1934 | Hallowell | 297/DIG. 4 |
| 3,031,227 | 4/1962 | Van Buren | 297/239 |
| 3,755,853 | 9/1973 | Barile | 297/239 X |

FOREIGN PATENT DOCUMENTS

| | | | |
|---|---|---|---|
| 200,604 | 1/1956 | Australia | 280/33.99 T |
| 510,570 | 8/1939 | United Kingdom | 297/239 |

*Primary Examiner*—Francis K. Zugel
*Attorney, Agent, or Firm*—Holman & Stern

[57] ABSTRACT

A stackable wheeled chair particularly for use in a mobile blood collection system. Each chair comprises a pair of laterally spaced, generally inverted U-shaped leg means. Each leg means includes front and rear leg members which diverge downwardly from an upper connecting member with flared offset portion at the lower end of each of each leg member rotatably supporting a caster means. Each leg means includes a stacking member spanning its front and rear leg members and positioned below the connecting member. The stacking members includes portions resting on the connecting member of the next lower chair in a stack with side portions to preclude lateral tipping. The wheels of the caster members ride on the flared portion of the next lower chair in a stack to preclude front-to-back tipping. Substantially no other contact exists between the stacked chairs to preclude wedging.

6 Claims, 4 Drawing Figures

STACKABLE WHEELED CHAIR

BACKGROUND OF THE INVENTION

This invention relates to a stackable chair and relates more particularly to a stackable chair having casters.

The chair of the instant invention is particularly adapted for use in a mobile blood collection system as a nurse's chair. With such a system it is common practice to provide a truck or the like adapted to carry a multiplicity of patient lounges, nurse's chairs and other paraphernalia, all of which must be compactly stored for movement between locations. On site, the lounges are ordinarily arranged so that a single nurse is capable of treating a number of patients simultaneously. Thus, it is important that the chairs be on wheels. Moreover, it is necessary that such chairs be capable of stacking for transportation compactness.

In order to provide optimum conditions, it is preferable that at least six and possibly more nurses' chairs be nested in a single stack. Such an arrangement, particularly with wheeled chairs, is difficult since a stack of this height is ordinarily quite unstable. Thus, it is important to provide good stability both laterally and front-to-back in the stacked assembly.

Moreover, individual chairs must be easily stacked and easly removed from a stack. Therefore, in addition to providing the stability, care must be taken to insure that the chairs do not wedge when stacked so that they can be readily moved from the stack for use.

Although the instant inventive concepts are directed to a stackable wheeled chair having particular utility in a mobile blood collection system as a nurse'chair, it is obvious that the chair of this invention has general utility in any environment in which it is necessary or desirable to nest a plurality of chairs with wheels.

A primary object of this invention is the provision of a stackable wheeled chair which, in stacked relationship, provides lateral as well as front-to-back stability, and which enables the stacking of a relatively large number of chairs for compact storage or transportation.

A further object of this invention is the provision of a stackable wheeled chair which, when stacked, has minimal contact between the individual chairs in a stack so as to provide stability, without causing wedging thereby simplifying removal of individual chairs from the stack.

Yet another object of this invention is the provision of a stackable wheeled chair which, in stacked relationship, takes a minimum of space and, when separated, functions in a highly efficient manner.

A still further object of this invention is the provision of a stackable wheeled chair which is simple and inexpensive to manufacture, sturdy and durable in construction and aesthetically quite pleasing.

Still other objects will in part the obvious and in part be pointed out as the description of the invention proceeds and as shown in the accompanying drawings wherein.

Like reference numerals refer to like parts throughout the several views of the drawings.

Figure 1:
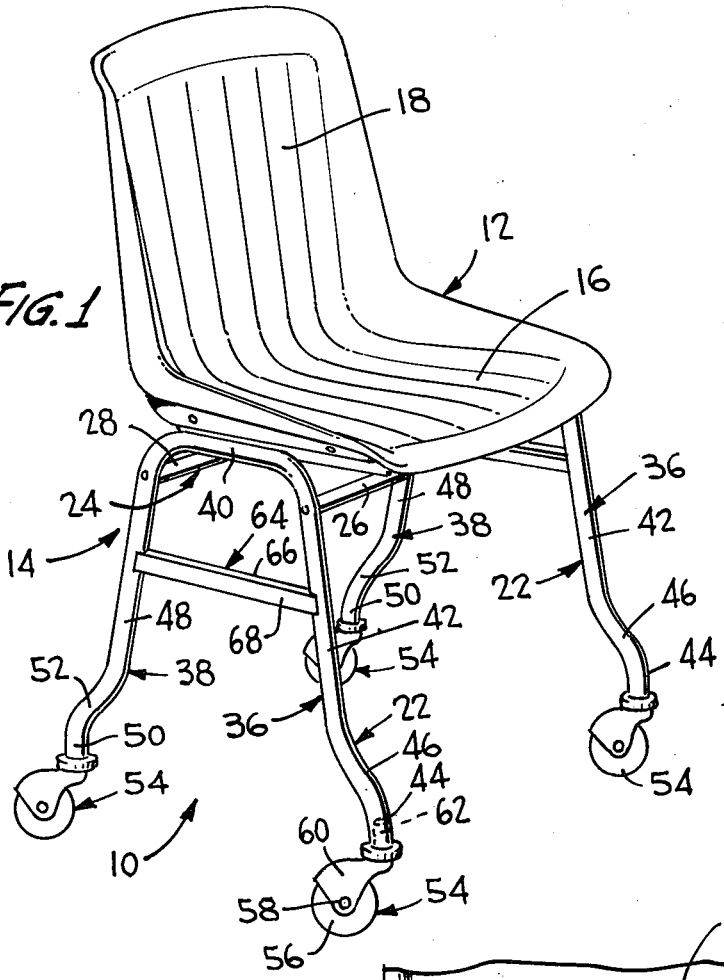
FIG. 1 is a perspective view of a stackable wheeled chair according to one embodiment of the instant inventive concepts.

Referring now to the drawings, a stackable wheeled chair according to the instant inventive concepts is designated generally by the reference numeral 10 and comprises basically a seal means 12 and a supporting frame means 14.

The seat means 12 is shown as an integral plastic element including a seat portion 16 and a backrest portion 18 with downwardly depending flanges 20 (note particularly FIG. 3) for a purpose to be described in more detail hereinafter.

It should be understood that the seat means 12 can be formed of any desirable material, although polypropylene or the like has been found particularly useful. However, the specific design of the seat means 12 is not critical to the instant inventive concepts, with the exception that the seat means must be nestable when the chairs 10 are stacked in the manner shown in FIGS. 2–4.

The supporting frame means 14 may also be formed of any suitable material, such as aluminum or the like, although steel has been found preferred. The supporting frame means comprises a pair of laterally spaced, generally inverted U-shaped leg means 22 with transversely extending stringer means 24 securing the leg means 22 to each other and carrying the seat means 12. In the embodiment shown, the stringer means 24 includes a pair of transversely extending stringer members 26, 28 with a pair of L-shaped longitudinally extending stringers 30, 32 secured by rivets or the like 34 to the flanges 20 of the seat means 12.

The leg means 22 each comprise a front and rear normally upstanding leg member 36, 38, the upper ends of which are interconnected by a connecting member 40. In the embodiment shown the leg members 36, 38 and the connecting members 40 of each leg means 22 is an integral tubular member bent to form the generally inverted U-shape.

As will be seen from the drawings, the front and rear leg members 36, 38 diverge from their upper ends to their lower ends such that the upper ends are closer to each other than the lower ends. Specifically, the front leg members 36 each include an upper portion 42 which extends downwardly and forwardly from the connecting member 40, with a lower portion 44 extending generally vertically (note particularly FIG. 2) and an intermediate flared portion 46 interconnecting the upper and lower portions 42, 44 and extending downwardly and forwardly at a greater angle to the vertical than the upper portion 42. Similarly, each rear leg member includes an upper downwardly and rearwardly extending portion 48, a lower generally vertically extending portion 50 and an intermediate flared portion 52 interconnecting said upper and lower portions 48, 50 and extending downwardly and rearwardly at a greater angle to the vertical than the upper portion 48.

Caster means 54 are carried by the lower end of each front and rear leg member. Each caster means 54 includes a wheel member 56 rotatably supported about a generally horizontally extending axle member 58 carried by a conventional offset wheel support member 60 including a generally vertically extending pin 62 rotatably supported and retained in the lower end portions 44, 50 of the leg members 36, 38, respectively, in a conventional manner. One such pin is shown in dotted lines in FIG. 1 as illustrative.

A generally L-shaped stacking member 64 spans the front and rear leg members 36, 38 of each leg means 22 below the connecting members 40. The stacking members 64 comprise a generally horizontally extending portion 66 and a generally vertically extending portion 68 (note particularly FIGS. 1 and 3), the vertically extending portions 68 being spaced apart slightly more than the outer surface of the connecting members 40.

Figure 2:
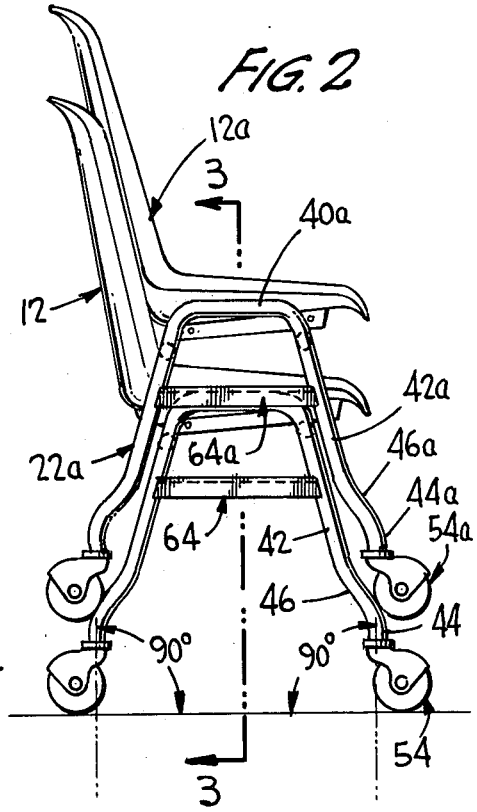
FIG. 2 is a side elevational view showing a pair of chairs in stacked relationship.
Figure 3:
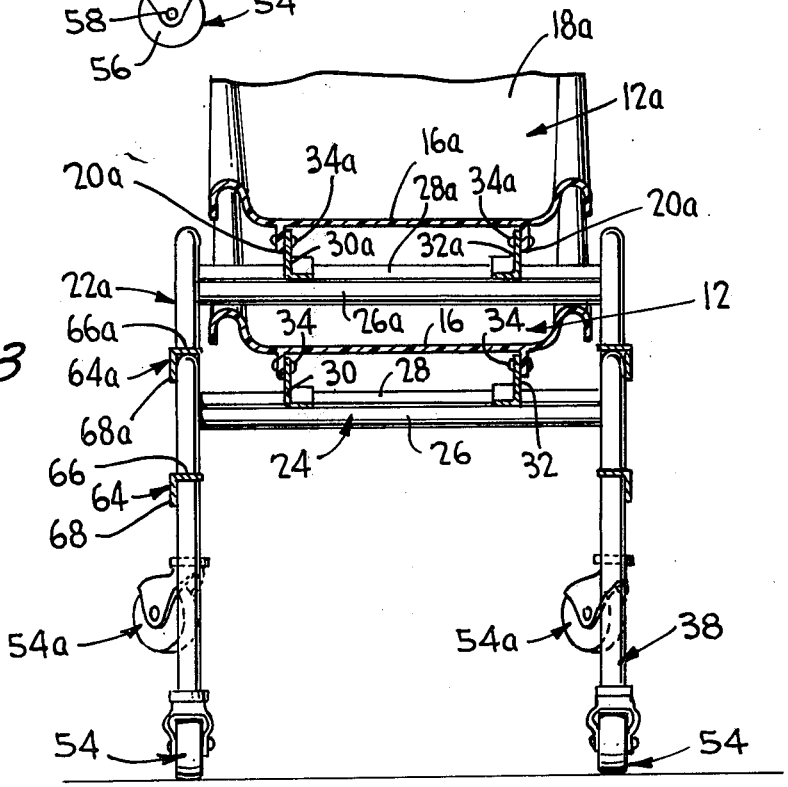
FIG. 3 is a fragmentary cross sectional view taken substantially along lines 3—3, with parts being broken away for illustrative convenience.
Figure 4:
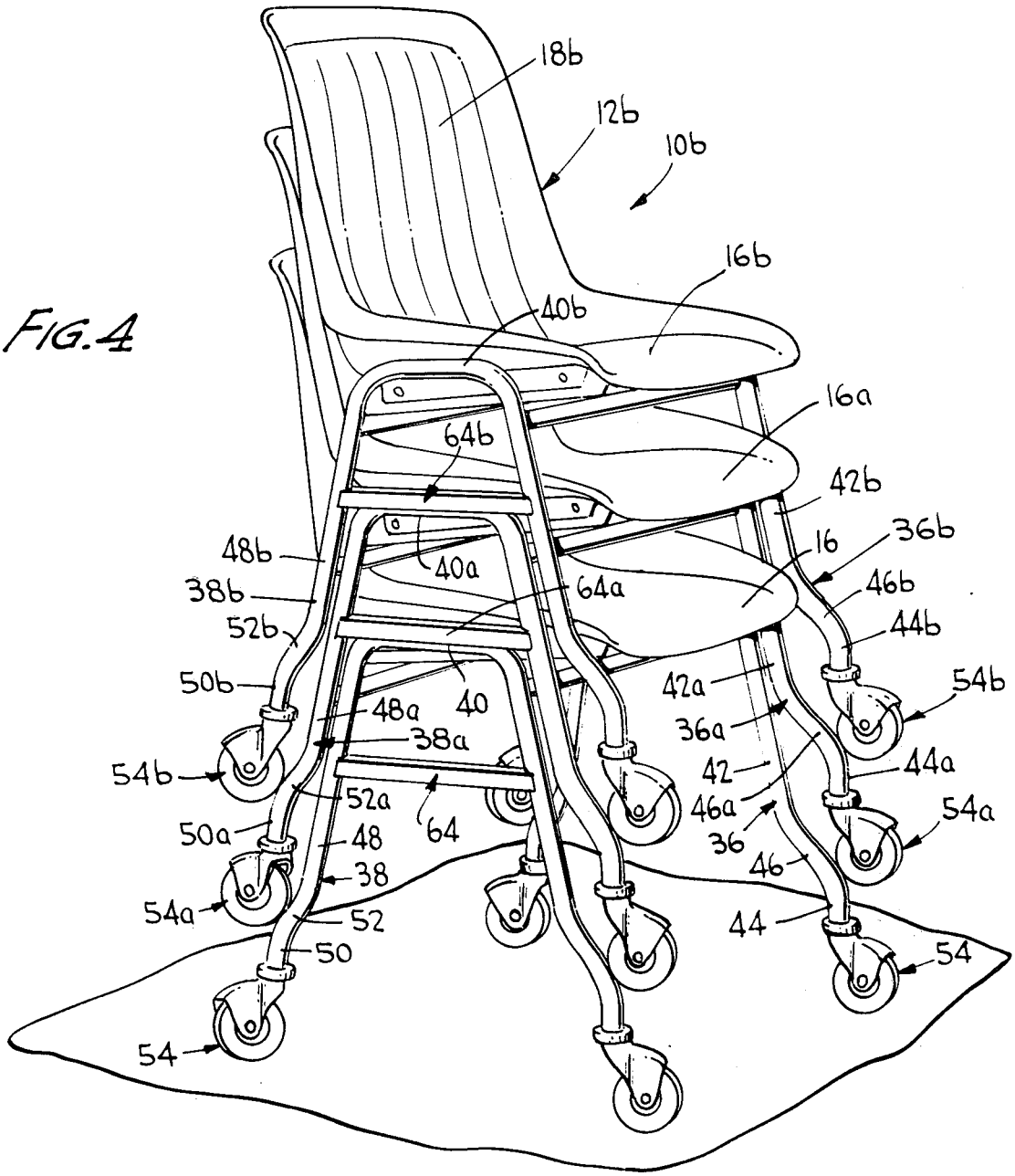
FIG. 4 is an enlarged perspective view of a stack of wheeled chairs according to this invention.

Reference is made now particularly to FIGS. 2–4 wherein the stacked relationship of the chairs will be seen. Each of the chairs are substantially identical, but for illustrative convenience and clarity, portions of the upper chairs in a stack are designated by the same reference numeral followed by the suffix "*a*" or "*b*" to identify individual chairs.

In the stacked relationship, the generally horizontally extending portions **66*a* or 66*b* of a stacking member 64*a* or 64*b* rest on the upper surface of a connecting member 40 or 40*a* of the next lower chair in a stack and generally vertically extending portions 68*a* or 68*b* engage the outer side surface of a connecting member 40*a* or 40 of the next lower chair in a stack with a slight spacing therebetween to provide side-to-side security to a stack of chairs without wedging of these elements. Further, each of the wheel members 56*a* or 56*b* engage against the upper surface of the flaring portion 44*a* or 44** of the next lower chair in a stack to provide front-to-back security to a stack of chairs.

As will be seen particularly in FIGS. 2 and 4, the contact between the leg means of stacked chairs substantially only occurs at the aforementioned points, that is, at the points at which the stacking members engage the connecting members of the next lower chair and at the points at which the wheel members engage the flaring portions of the leg members of the next lower chair. Specifically, no substantial contact exists between the upper portions **42*a*, 42*b* or 48*a*, 48*b* and comparable portions in the next lower chair 42*a*, 42 or 48*a*, 48.** Moreover, the remaining contact is either with a slight spacing as with the stacking members or a point contact as with the wheels. In this manner, wedging of the chairs is precluded.

Thus, it will now be seen that there is herein provided a stackable wheeled chair which has excellent side-to-side and front-to-back stability while enabling individual chairs to be lifted from the stack in a easy manner. Although only three chairs are shown in FIG. 4, six or more such chairs of this design have been stacked for compact storage or movement without tipping. A stack of such chairs can be placed on a conventional wheeled dolly or handcart and moved for transportation without fear of tipping or disassembly of the stack.

All of the foregoing objects, and others, will be seen to be satisfied by the instant inventive concepts, including many advantages of great practical utility and commercial importance.

The embodiments of the invention in which an exclusive property or privilege is claimed are defined as follows:

1. A stackable wheeled chair comprising:

seat means;

supporting frame means carrying said seat means;

said frame means including:

a pair of laterally spaced generally inverted U-shaped leg means, and transversely extending stringer means having laterally spaced ends secured respectively to said leg means, said seat means being carried by said stringer means intermediate said ends;

said leg means each comprising:

a front and a rear normally upstanding leg member each having upper and lower ends, a connecting member connecting said upper ends of said front and rear leg members of each pair to each other to form said generally inverted U-shaped leg means;

a stacking member spanning said front and rear leg members in each leg means below said connecting member, and caster means carried by said lower end of each front and rear leg member;

said front and rear leg members of each leg means diverging from said upper ends to said lower ends thereof whereby said upper ends of said front and rear leg members are closer to each other than said lower ends;

said front leg member including an upper portion terminating in said upper end and extending downwardly and forwardly therefrom, a lower portion terminating in said lower end and extending generally vertically, and an intermediate flared portion interconnecting said upper and lower portions and extending downwardly and forwardly at a greater angle to the vertical than said upper portion, each rear leg member including an upper portion terminating in said upper end and extending downwardly and rearwardly therefrom, a lower portion terminating in said lower end and extending generally vertically, and an intermediate flared portion extending downwardly and rearwardly at a greater angle to the vertical than said upper portion, said caster means each including a caster member comprising a wheel member, a generally horizontally extending axle rotatably supporting said wheel member, an offset wheel support member carrying said axle and including a generally vertically extending pin, said pin being rotatably supported about a generally vertically extending axis in said lower end portion of its respective leg member;

each of said stacking members comprising a generally horizontally extending portion adapted to rest on the upper surface of a connecting member of the next lower chair in a stack and a generally vertically extending portion adapted to engage against the outer side surface of a connecting member of the next lower chair in a stack to provide side-to-side security to a stack of chairs, and each of said wheel members being adapted to engage against the upper surface of said flaring portion of a leg member of the next lower chair in a stack when the front and rear offset supports extend fowardly and rearwardly, respectively, to provide front-to-back security to a stack of chairs;

said leg means, connecting member, stacking members, flaring portions, and wheel members being so arranged and constructed that contact between leg means of stacked chairs substantially only occurs at the points at which said stacking members engage said connecting members and said wheel members engage said flaring portions to thereby preclude wedging of stacked chairs.

2. The chair of claim 1 wherein said seat means includes a seat portion and a backrest portion.

3. The chair of claim 2 wherein said seat and backrest portions are integral and said seat portion is secured to said stringer means.

4. The chair of claim 1 wherein said front and back leg members and connecting members of each leg means are tubular.

5. The chair of claim 4 wherein said front and back leg members and connecting members of each leg means are integral.

6. The chair of claim 1 wherein said stacking member is generally L-shaped.

* * * * *